US006168149B1

(12) United States Patent
Boldrini

(10) Patent No.: US 6,168,149 B1
(45) Date of Patent: Jan. 2, 2001

(54) METHOD AND UNIT FOR FEEDING BLANKS TO A USER MACHINE

(75) Inventor: Fulvio Boldrini, Ferrara (IT)

(73) Assignee: G.D Societa' Per Azioni, Bologna (IT)

( * ) Notice: Under 35 U.S.C. 154(b), the term of this patent shall be extended for 0 days.

(21) Appl. No.: 09/146,612

(22) Filed: Sep. 3, 1998

(30) Foreign Application Priority Data

Sep. 4, 1997 (IT) ..... BO97A0533

(51) Int. Cl.[7] ..... B65H 3/08

(52) U.S. Cl. ..... 271/107; 271/11; 271/99; 271/9.12; 271/9.13; 493/315; 414/737

(58) Field of Search ..... 271/12, 11, 99, 271/107, 9.05, 9.12, 9.13; 493/313, 315, 317, 316; 414/797, 797.3, 797.4, 797.7, 737, 752

(56) References Cited

U.S. PATENT DOCUMENTS

| | | | | |
|---|---|---|---|---|
| 3,937,458 | * | 2/1976 | Langen | 271/95 |
| 4,194,442 | * | 3/1980 | Martelli | 271/95 |
| 4,299,533 | * | 11/1981 | Ohnaka | 414/752 |
| 4,537,587 | * | 8/1985 | Langen | 493/315 |
| 4,871,348 | * | 10/1989 | Konaka | 493/315 |
| 4,881,934 | * | 11/1989 | Harston et al. | 493/315 |
| 4,901,996 | * | 2/1990 | Schlough | 271/10 |
| 4,951,445 | * | 8/1990 | Thibault | 53/167 |
| 5,049,119 | * | 9/1991 | Bershadsky | 493/315 |
| 5,061,231 | * | 10/1991 | Dietrich et al. | 493/315 |
| 5,102,385 | * | 4/1992 | Calvert | 493/315 |
| 5,207,630 | * | 5/1993 | Decker et al. | 493/313 |
| 5,215,515 | * | 6/1993 | Bershadsky | 493/315 |
| 5,298,008 | * | 3/1994 | Decker et al. | 493/313 |
| 5,456,570 | * | 10/1995 | Davis et al. | 414/742 |
| 5,511,772 | | 4/1996 | Ganz et al. . | |
| 5,603,599 | * | 2/1997 | Wesslen et al. | 414/411 |
| 5,642,878 | * | 7/1997 | Smithe et al. | 271/109 |
| 5,662,577 | * | 9/1997 | Reuteler | 493/315 |
| 5,700,004 | * | 12/1997 | Bahr et al. | 271/171 |
| 5,928,123 | * | 7/1999 | Davis, Jr. | 493/316 |
| 5,997,458 | * | 12/1999 | Guttinger et al. | 493/315 |

FOREIGN PATENT DOCUMENTS

| | | | | |
|---|---|---|---|---|
| 2547132 A1 | * | 5/1977 | (DE) . | |
| 44 39 723 | | 5/1996 | (DE) . | |
| 0 425 226 | | 5/1991 | (EP) . | |
| 2228257 | * | 8/1990 | (GB) | 271/11 |

* cited by examiner

*Primary Examiner*—Donald P. Walsh
*Assistant Examiner*—David A. Jones
(74) *Attorney, Agent, or Firm*—Marshall, O'Toole, Gerstein, Murray & Borun

(57) ABSTRACT

A method and unit for feeding blanks to a user machine, whereby at least two synchronized pickup heads withdraw the blanks from respective hoppers and feed them to respective conveying pockets moving continuously along a user path of the machine; each blank adheres by suction to a flat conveying surface of the respective pickup head, with a first lateral edge projecting outwards of the flat conveying surface and with a second edge contacting a push tooth projecting from the respective flat conveying surface, and is so inserted inside the respective conveying pocket as to be maintained in a flat configuration between the push tooth and a stop element moving together with the conveying pocket.

12 Claims, 5 Drawing Sheets

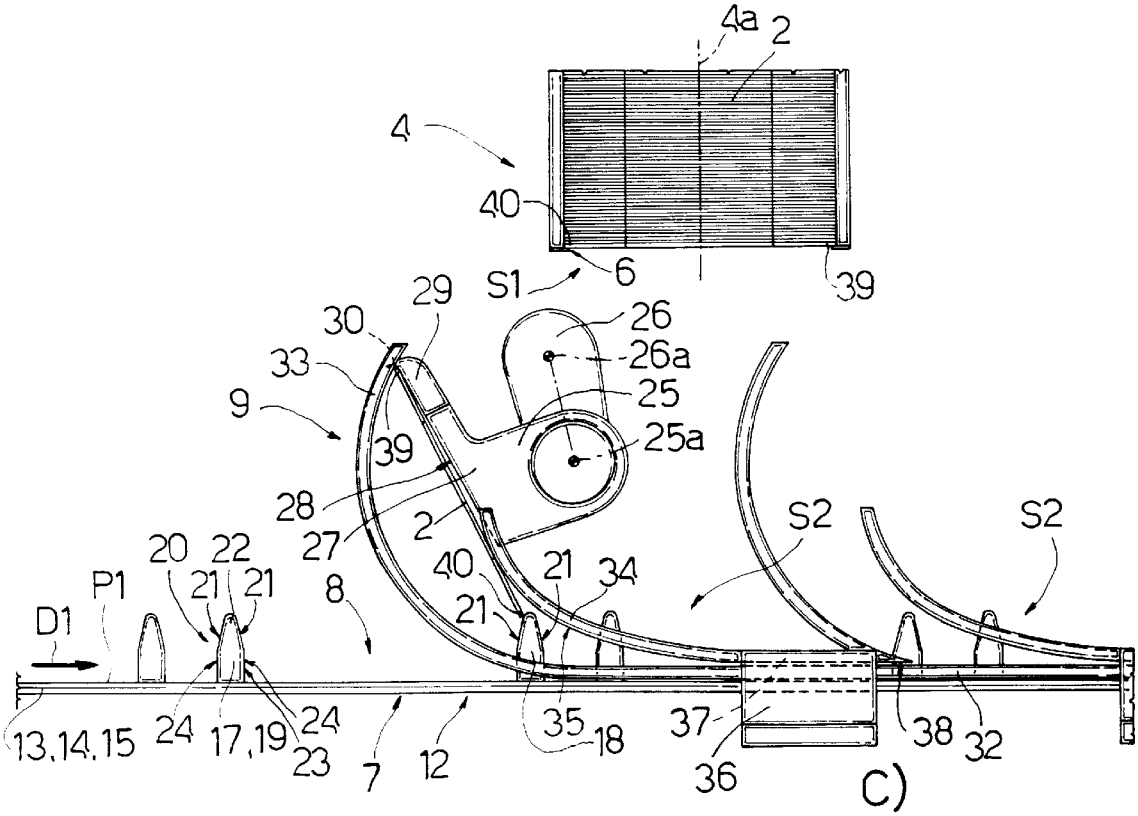
Fig.4
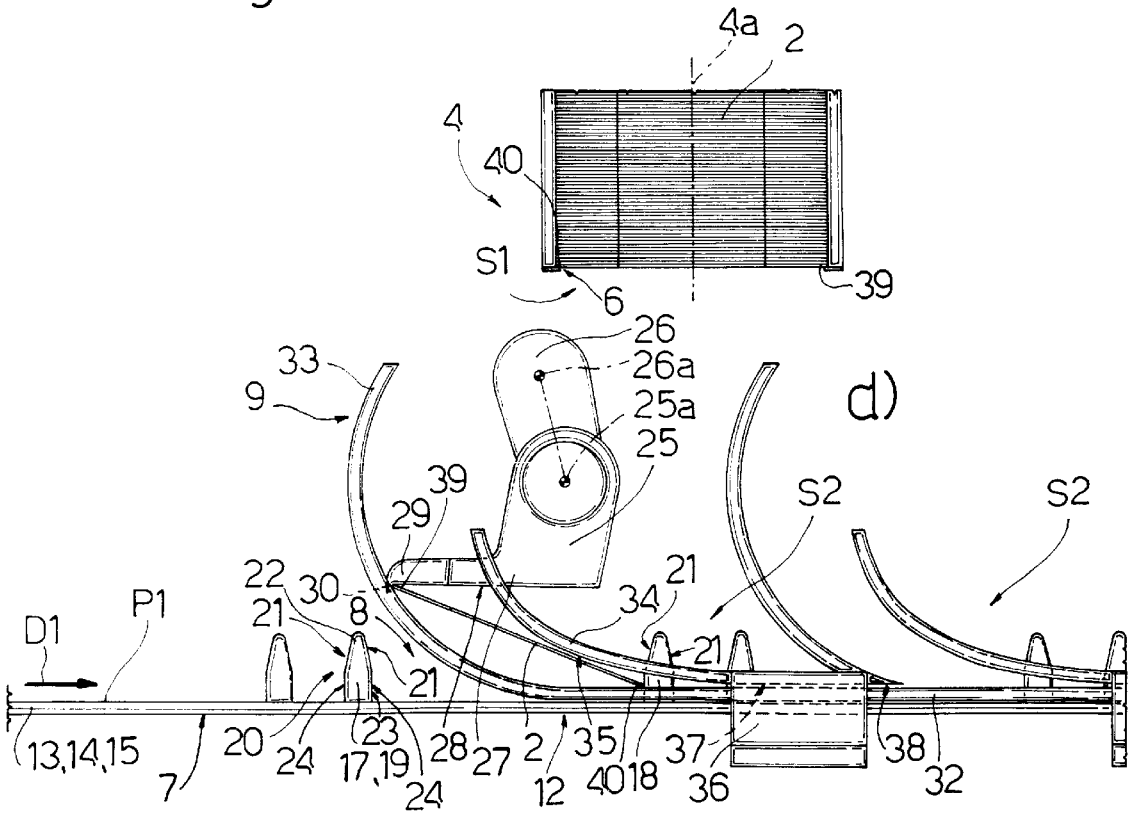

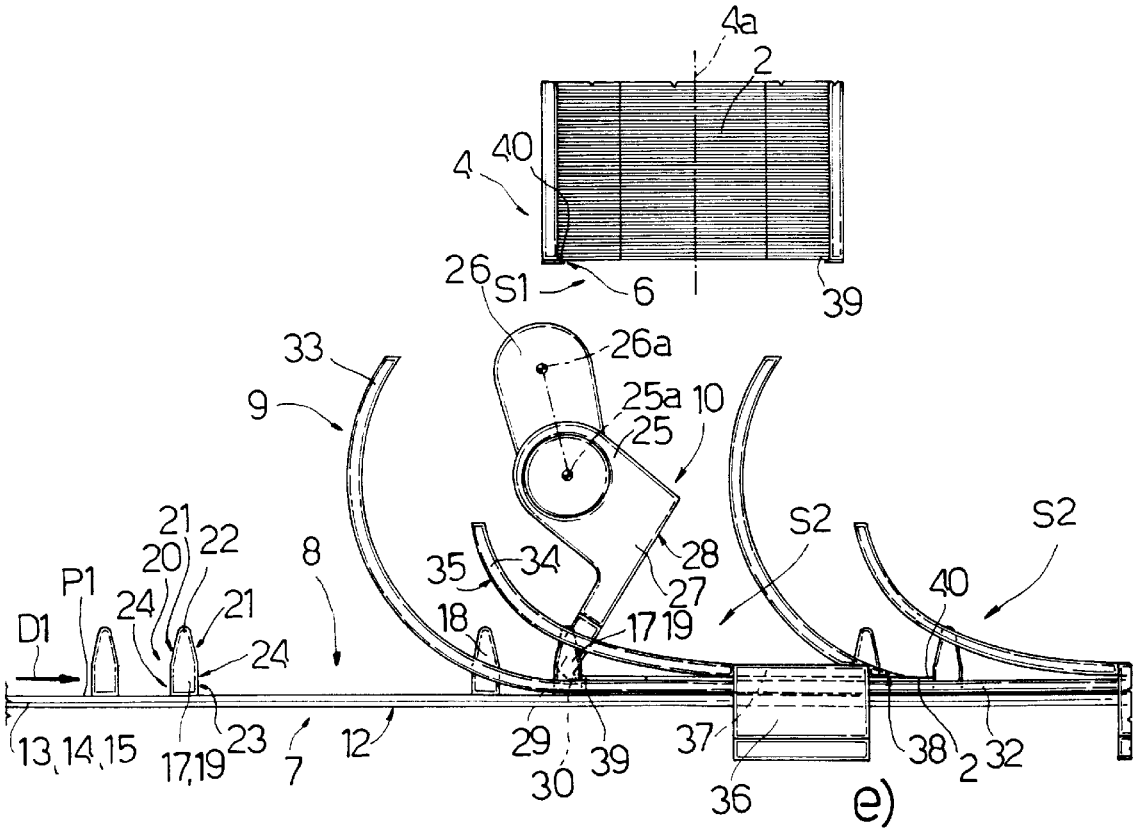
Fig. 5
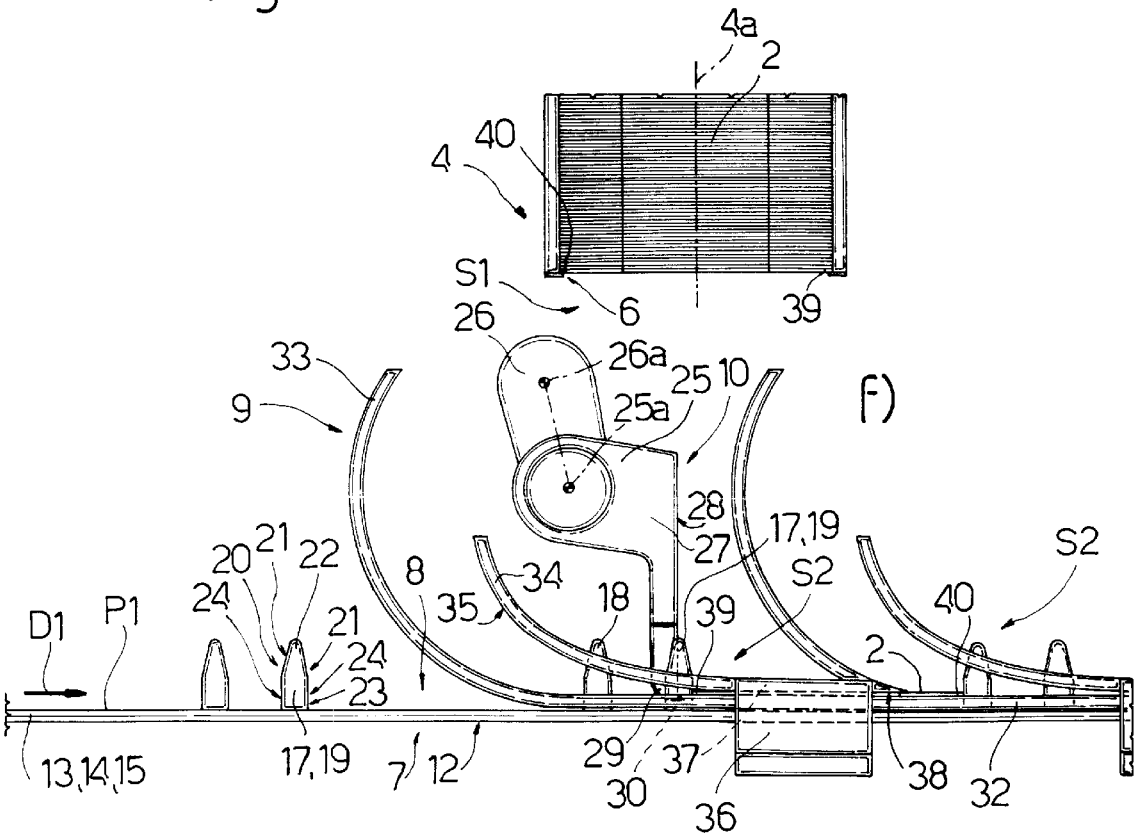

METHOD AND UNIT FOR FEEDING BLANKS TO A USER MACHINE

BACKGROUND OF THE INVENTION

The present invention relates to a method of feeding blanks to a user machine.

Blanks are fed to a user machine, such as a packing machine for folding the blanks about respective products, by feed units, which comprise a hopper containing a stack of blanks and having an open end from which the blanks are withdrawn; a transfer device located in front of, and for successively withdrawing the blanks from, the open end of the hopper; and a conveying device associated with the transfer device and for conveying the blanks to a user station of the packing machine.

Known transfer devices comprise one or more pickup heads, each of which travels cyclically past the open end of the hopper and past the conveying device to withdraw a respective blank, which adheres by suction to an outer surface of the head, and to feed the blank into a respective conveying seat on the conveying device, which is normally defined by a rotary drum for feeding the conveying seats along a circular path, or by a pocket conveyor for feeding the conveying seats along a straight linear path. In both cases, the outer surface of the pickup head must be curved to roll along the open end of the hopper and gradually detach the respective blank from the stack, and to gradually insert the blank into the respective conveying seat by rolling along the bottom surface of the conveying seat, which may also be curved or, as in the case of a pocket conveyor, flat.

Known feed units of the above type have several drawbacks, mainly due to the outer surfaces of the pickup heads, the curved shape of which forms a curve in the blanks which is later reflected in the shape of the packages formed when the blanks are folded about the respective products. Moreover, to withdraw the blanks from the hopper, the pickup heads must bend the blanks even more sharply to detach each one separately from the stack, thus further accentuating the curvature of the blank.

To overcome the above drawbacks, feed units have been devised comprising pickup heads with flat regular outer surfaces, and which are guided by crank mechanisms along respective cyclic paths, the pickup portion of which is substantially perpendicular to the open end of the hopper, and the unloading portion of which is substantially tangent to the bottom surfaces of the conveying pockets.

Even these new feed units, however, are not without drawbacks, in that, despite the blanks being withdrawn substantially undeformed from the hopper, the way in which the blanks are fed into the conveying pockets is fairly complex and unreliable.

SUMMARY OF THE INVENTION

It is an object of the present invention to provide a straightforward, low-cost method of feeding blanks to a user machine, designed to overcome the aforementioned drawbacks.

According to the present invention, there is provided a method of feeding blanks to a user machine, the method being characterized by comprising the steps of withdrawing blanks from a pickup station by means of a transfer device having at least one pickup head movable cyclically through the pickup station and through an unloading station, the pickup head having a flat conveying surface and at least one push tooth projecting from the flat conveying surface, and the blank adhering by suction to the flat conveying surface and being arranged with a respective first lateral edge projecting from the flat conveying surface and with a respective second lateral edge contacting said push tooth; engaging the first lateral edge of the blank against a stop element of a conveying pocket movable continuously along a user path of the user machine extending through said unloading station; detaching the blank from said flat conveying surface; and pushing the blank, by means of the push tooth, against the stop element to secure the blank between the stop element and the push tooth and maintain a flat configuration of the blank until the blank is fully inserted inside said conveying pocket.

The present invention also relates to a unit for feeding blanks to a user machine.

According to the present invention, there is provided a unit for feeding blanks to a user machine, the unit being characterized by comprising at least one conveying pocket movable continuously along a user path of the user machine; a transfer device having at least one pickup head movable cyclically through a pickup station to withdraw a respective blank, and through an unloading station, located along slid user path, to feed the blank to said conveying pocket, the pickup head comprising a flat conveying surface, at least one push tooth projecting from the flat conveying surface, and suction means by which the blank adheres to the flat conveying surface in such a manner that the blank has a respective first lateral edge projecting from the flat conveying surface and a respective second lateral edge contacting the push tooth, and said conveying pocket comprising a stop element for retaining the first lateral edge of the blank; and detaching means for detaching the blank from said flat conveying surface while maintaining the blank secured in a flat configuration between the stop element and the push tooth.

BRIEF DESCRIPTION OF THE DRAWINGS

A non-limiting embodiment of the present invention will be described by way of example with reference to the accompanying drawings, in which:

FIGS. 3, 4, 5 show smaller-scale side views of the FIG. 2 detail in a succession of respective operating positions.

DETAILED DESCRIPTION OF THE INVENTION

Figure 1:
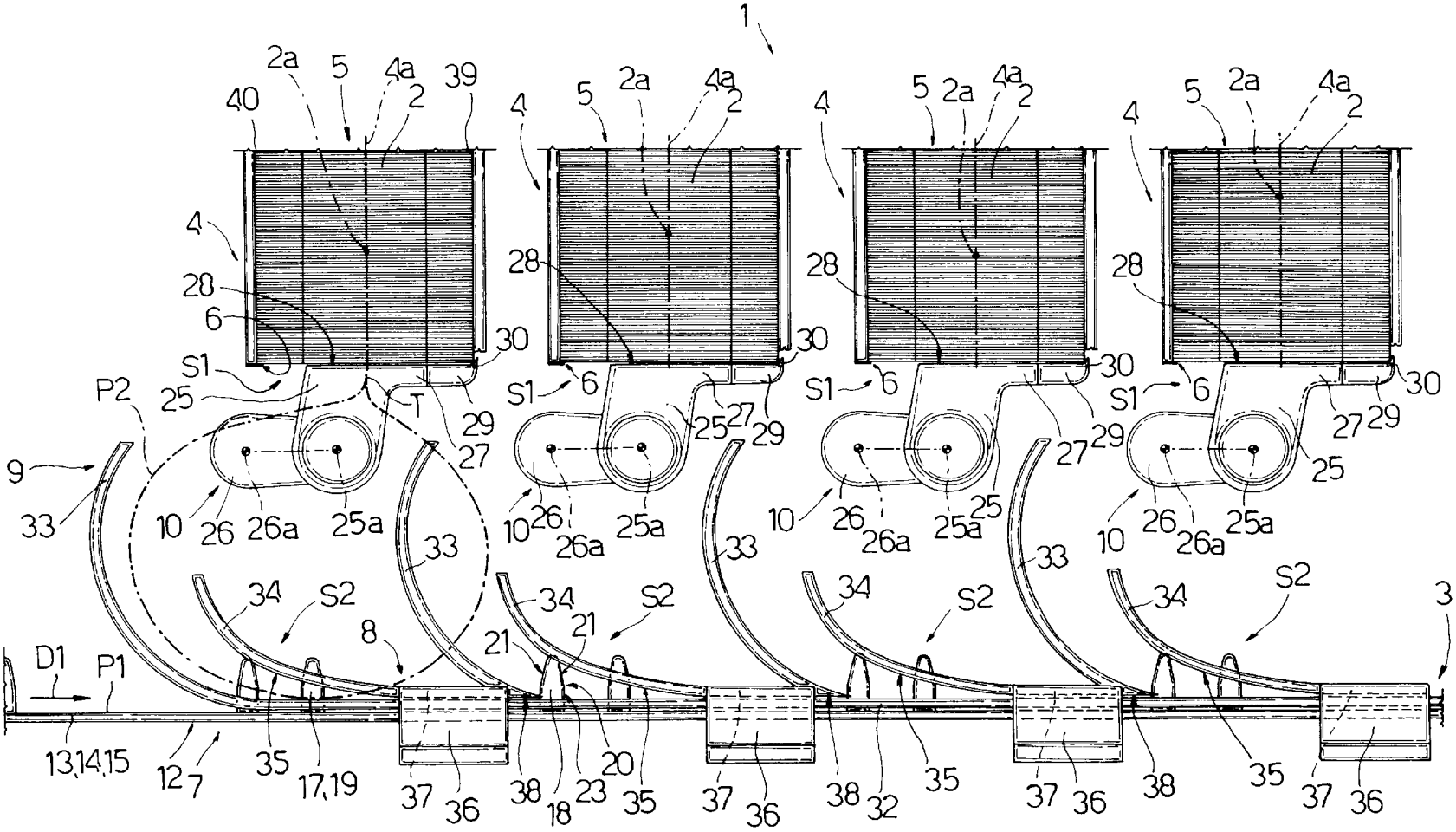
FIG. 1 shows a side view, with parts in section and parts removed for clarity, of a blank feed unit implementing the method according to the present invention.

Number 1 in FIG. 1 indicates as a whole a unit for feeding blanks 2 to a user machine 3 defined, in particular, by a packing machine for folding blanks 2 about respective products (not shown).

Unit 1 comprises a given N number of side by side hoppers 4 for feeding respective stacks 5 of blanks 2 to respective bottom openings 6 from which blanks 2 are withdrawn; a pocket conveyor 7 defining an input of machine 3 and having a number of conveying pockets 8 movable continuously in a given traveling direction D1 and along a packing path P1 extending beneath openings 6; and a transfer device 9 in turn comprising, for each hopper 4, a pickup head 10 movable along a respective feed path P2 extending between a pickup station S1 defined by respective opening 6, and a feed station S2 located along path P1 and where path P2 is substantially tangent to path P1. In the example embodiment shown, hoppers 4 are four in number, and transfer device 9 comprises four pickup heads 10 synchronized with one another to form, along conveyor 7, a succession 11 of blanks 2 (only one of which is shown in FIG. 2).

Each hopper 4 feeds respective stack 5 of blanks 2 by gravity to respective opening 6 along a vertical axis 4*a* of hopper 4; blanks 2 are arranged in respective stack 5 with respective major longitudinal axes 2*a* crosswise to axis 4*a* and direction D1; each opening 6 is parallel to a conveying branch 12 of conveyor 7; and, at pickup station S1, respective path P2 comprises a portion T along which respective head 10 moves back and forth, and which is parallel to axis 4*a* of respective hopper 4 and crosswise to opening 6.

Figure 2:
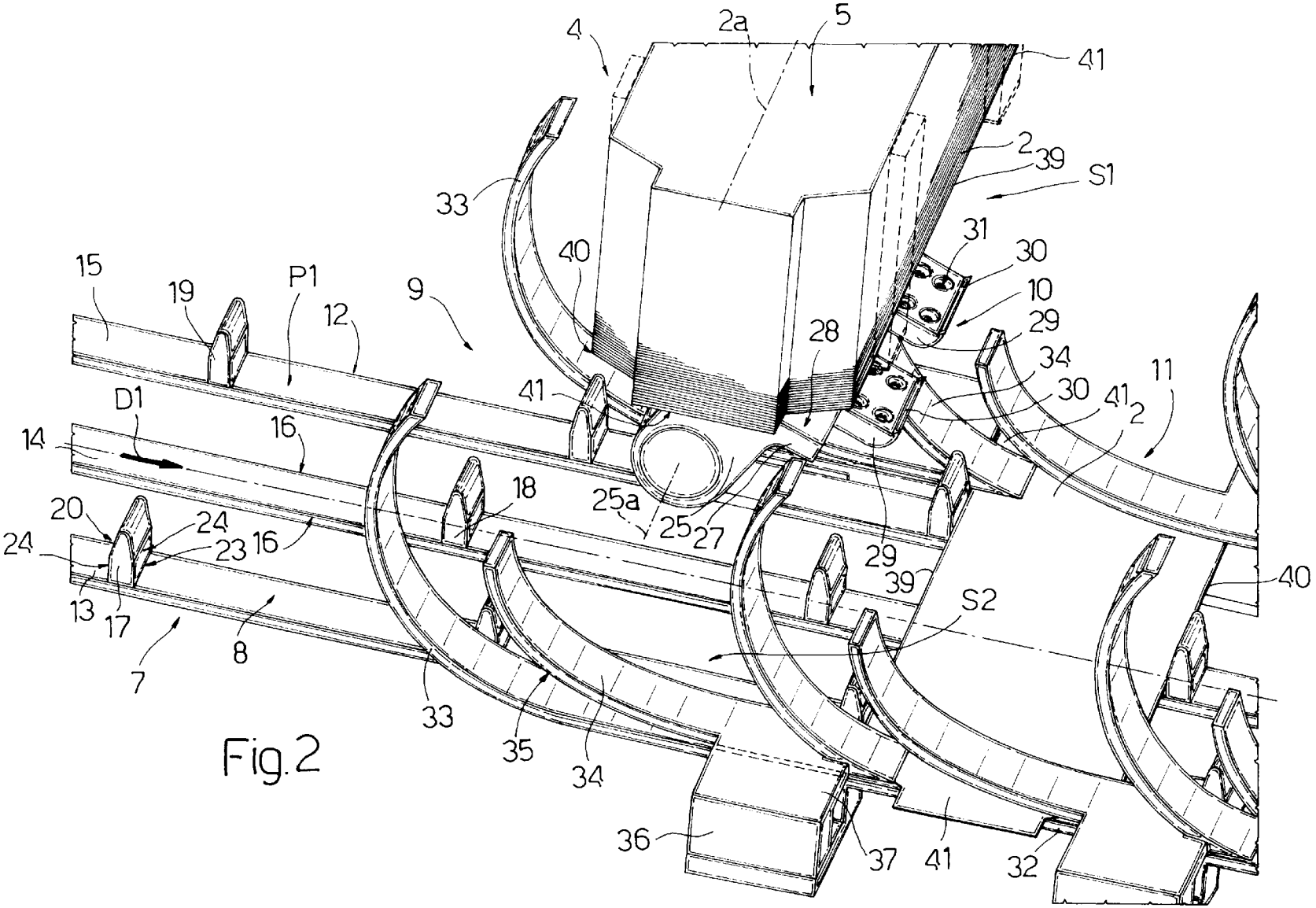
FIG. 2 shows a larger-scale view in perspective of a detail of FIG. 1.

As shown in FIG. 2, conveyor 7 comprises three side by side endless belts 13, 14, 15, which are so spaced as to define, along conveying branch 12 of conveyor 7, two openings 16 parallel to direction D1, and have respective series of shaped projections 17, 18, 19, the projections in each series being arranged with a given spacing. More specifically, belt 14 is located in an intermediate position between belts 13 and 15, with respective projections 18 offset, in direction D1, with respect to projections 17 and 19 of belts 13 and 15, whereas each projection 17 is aligned, crosswise to direction D1, with a corresponding projection 19. Each pocket 8 is defined by two aligned projections 17 and 19, and by a projection 18 located downstream from projections 17 and 19 in direction D1 and at a distance D adjustable according to the size of blanks 2. Each projection 17, 18, 19 comprises a substantially wedge-shaped free top portion 20 defined by two upwardly-converging lateral surfaces 21 connected by a rounded top surface 22; and a substantially parallelepiped bottom portion 23 connected to respective belt 13, 14, 15 and defined by two vertical surfaces 24 crosswise to conveying branch 12 and direction D1.

Each pickup head 10 is fitted to a crank 26, which is located beneath respective opening 6, is offset laterally with respect to axis 4*a* of respective hopper 4, and is mounted for rotation about a respective horizontal axis 26*a* crosswise to direction D1. Each head 10 comprises a shaped body 25 fitted to a free end of crank 26 so as to rotate about an axis 25*a* parallel to axis 26*a*; and a suction plate 27 connected to body 25 and having a flat conveying surface 28 parallel to axis 25*a*. Surface 28 also extends partly over two lateral appendixes 29, which project from plate 27, are of a width approximately equal to but no greater than the width of openings 16, and are each provided with a respective push tooth 30 extending crosswise to surface 28 on the opposite side of surface 28 to body 25. Each plate 27 and respective appendixes 29 comprise a number of suction holes 31 connected to a known suction device (not shown) for retaining a blank 2 by suction on surface 28 as blank 2 is transferred from station S1 to station S2.

By means of known actuating means (not shown), each crank 26 oscillates about axis 26*a* between a raised position (FIGS. 1 and 3*a*) in which head 10 is located at pickup station S1, and a lowered position (FIGS. 3*b*–5*f*) in which crank 26 positions head 10 at such a distance from conveying branch 12 of conveyor 7 as to enable head 10 to insert respective blank 2 inside a respective pocket 8.

Finally, transfer device 9 comprises two guides 32 for supporting blanks 2 and defined by respective rectangular section elements, which extend along path P1, alongside belts 13 and 15 and at a higher level than conveying branch 12 of conveyor 7 to substantially support the ends of blanks 2 inside pockets 8. Device 9 also comprises, for each station S2, two curved guide elements 33 located on either side of conveyor 7 and extending substantially along the trajectories traveled by push teeth 30 as plates 27 rotate about axes 25*a*; and two curved engaging elements 34, which are located in front of respective elements 33, are less sharply curved than elements 33, and define, with elements 33, two funnel-shaped channels 35 converging towards path P2. More specifically, the elements 33 at the first of stations S2 along path P2 are formed in one piece from respective end portions of guides 32; elements 34 of each station S2 are connected to guides 32 by respective supports 36; and elements 33 at the other stations S2 are also connected to supports 36, each of which comprises a top plate 37 extending over guides 32 and at such a distance from guides 32 as to leave a gap 38 for the passage of blanks 2 inside pockets 8.

Operation of feed unit 1 will now be described with reference to FIGS. 3, 4 and 5 and to only one of pickup heads 10, since, besides being structurally identical, all four pickup heads 10 are also synchronized with one another to perform the same movements simultaneously. In the following description, specific reference will also be made to blanks 2 of the type normally used in the packing industry, and which are defined laterally by two long edges 39 and 40 parallel to respective axes 2*a*.

The supply of a blank 2 from hopper 4 to a conveying pocket 8 moving continuously along path P1 beneath hopper 4 commences the instant crank 26 of head 10 is set to the raised position (FIG. 3*a*) and plate 27 is positioned at station S1 with respective flat surface 28 substantially coplanar with opening 6. At which point, the suction device is activated so that the blank 2 facing opening 6 adheres to surface 28. More specifically, the pickup position of plate 27 is such that blank 2 contacts surface 28 with edge 39 contacting push teeth 30, with edge 40 projecting outwards from surface 28, and with two end portions 41, crosswise to axis 2*a*, projecting laterally from opposite sides of surface 28.

Figure 3A:
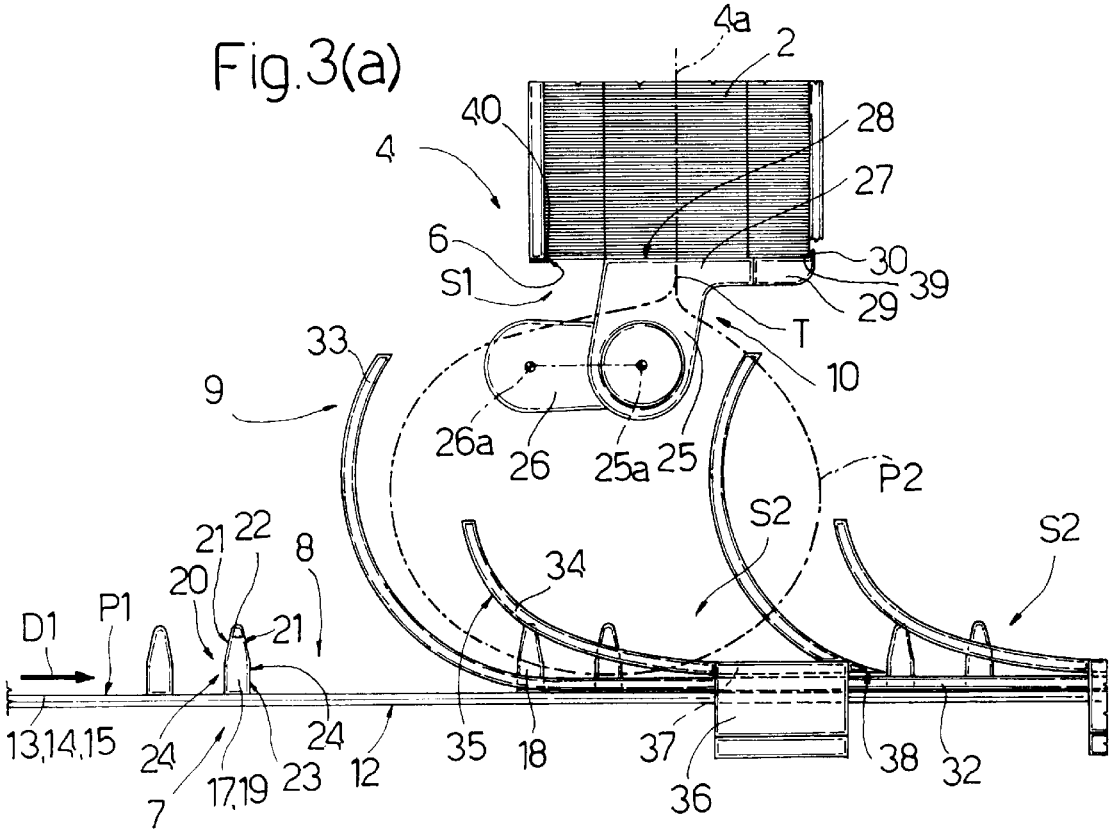
Figure 3B:
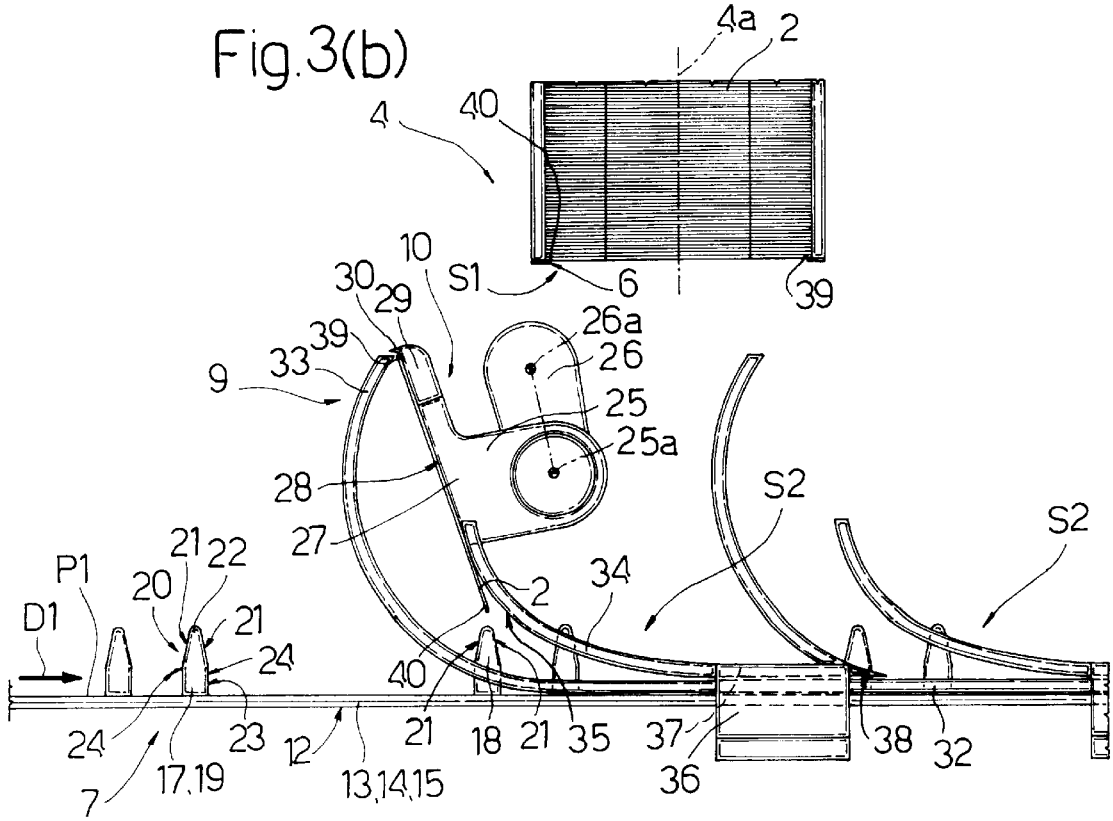

Once the blank is positioned fully contacting surface 28, crank 26 is rotated clockwise in FIGS. 3*a* and 3*b*) about axis 26*a* into the lowered position so as to withdraw blank 2 from hopper 4 and detach it from stack 5. Substantially at this point, plate 27 is rotated (anticlockwise in FIG. 3*b*) by said actuating means, and blank 2 is gradually inserted inside channels 35 with respective edge 40 forwards.

As edge 39 of the blank slides along guide elements 33 and teeth 30 slide alongside elements 33, end portions 41 engage elements 34 in sliding manner, but, as blank 2 advances inside channels 35, and on account of the different curvatures of elements 33 and 34, portions 41 collide with elements 34, and blank 2 is detached from surface 28 as edge 40 engages the surface 21 of a projection 18 facing inwards of pocket 8 (FIG. 4*c*).

Blank 2 is detached from surface 28 simultaneously with deactivation of the suction device, but, as opposed to being released onto guides 33, is retained in a flat configuration between teeth 30 and projection 18, along surfaces 21 and 24 of which, edge 40 is eased right down to the bottom of pocket 8 with no deformation of blank 2. The rotation speed of crank 26 about axis 26*a* and the traveling speed of pockets 8 along path P1 are such that, firstly, blank 2 is pushed constantly by teeth 30 against projection 18, and, secondly, edge 40, on sliding into contact with surface 24 and guides 32, acts as the center of instantaneous rotation of blank 2 (FIG. 4*d*), so that, as pocket 8 and teeth 30 continue moving forward, blank 2 is inserted inside pocket 8 in a position parallel to conveying branch 12 of conveyor 7 (FIG. 5*e*).

When surface 28 is positioned crosswise to conveying branch 12 (FIG. 5*f*) and teeth 30 are engaged in sliding manner inside openings 16, blank 2 is fully inserted inside pocket 8 and crank 26 is gradually restored to the raised position. At the same time, plate 27 is rotated about axis 25*a*, so that, along portion T, surface 28 is oriented crosswise to axis 4*a* of hopper 4, and is moved parallel to itself towards opening 6.

The blanks 2 by now on conveyor 7 are fed along path P1, and respective end portions 41 contacting guides 32 are fed through gaps 38 of the various stations S2 until a further four conveying pockets 8 move into respective stations S2. Upon respective surfaces 28 of heads 10 contacting respective further blanks 2 facing respective openings 6, each head 10 again operates in the same way as described above.

What is claimed is:

1. A method of feeding blanks to a user machine, the method comprising the steps of withdrawing blanks (2) from a pickup station (S1) by means of a transfer device (9) having at least one pickup head (10) movable cyclically through the pickup station (S1) and through an unloading station (S2), the pickup head (10) having a flat conveying surface (28) and at least one push tooth (30) projecting from the flat conveying surface (28), and the blank (2) adhering by suction to the flat conveying surface (28) and being arranged with a respective first lateral edge (40) projecting from the flat conveying surface (28) and with a respective second lateral edge (39) contacting said push tooth (30); engaging the first lateral edge (40) of the blank (2) against a stop element (18) of a conveying pocket (8) movable continuously along a user path (P1) of the user machine (3) extending through said unloading station (S2); detaching the blank (2) from said flat conveying surface (28); and pushing the blank (2), by means of the push tooth (30), against the stop element (18) to secure the blank (2) between the stop element (18) and the push tooth (30) and maintain a flat configuration of the blank (2) until the blank (2) is fully inserted inside said conveying pocket (8); the step of detaching the blank (2) from said flat conveying surface (28) being performed by engaging at least one end portion (41) of the blank (2) along respective engaging means (34) located alongside said user path (P1) at said unloading station (S2); wherein the method comprises the step of guiding the blank (2), during insertion of the blank (2) inside the respective conveying pocket (8), by engaging said second lateral edge (39) in sliding manner by means of guide means (33) facing said engaging means (34) at said unloading station (S2).

2. A method as claimed in claim 1, wherein said transfer device (9) comprises at least two pickup heads (10) movable cyclically through respective pickup stations and unloading stations (S1, S2); each pickup head (10) inserting the respective blank (2) inside a respective conveying pocket (8) to form a succession (11) of blanks (2) along said user path (P1).

3. A method as claimed in claim 2, wherein said two pickup heads (10) are synchronized with each other.

4. A method as claimed in claim 1, wherein said user path (P1) is a straight path; said pickup head (10) being movable along a feed path (P2) tangent to the user path (P1) at said unloading station (S2).

5. A method as claimed in claim 4, wherein said pickup station (S1) is defined by an open end (6) of a hopper (4) containing a stack (5) of blanks (2); said feed path (P2) comprising a portion (T) perpendicular to said open end (6); and said flat conveying surface (28) of said pickup head (10) being moved towards said open end (6) into a position coplanar with a blank (2) located at said open end (6).

6. A method as claimed in claim 5, wherein said transfer device (9) comprises an oscillating element (26) for supporting said pickup head (10); the pickup head (10) being fitted in rotary manner to the oscillating element (26).

7. A unit for feeding blanks to a user machine, the unit (1) comprising at least one conveying pocket (8) movable continuously along a user path (P1) of the user machine (3); a transfer device (9) having at least one pickup head (10) movable cyclically through a pickup station (S1) to withdraw a respective blank (2), and through an unloading station (S2), located along said user path (P1), to feed the blank (2) to said conveying pocket (8), the pickup head (10) comprising a flat conveying surface (28), at least one push tooth (30) projecting from the flat conveying surface (28), and suction means (31) by which the blank (2) adheres to the flat conveying surface (28) in such a manner that the blank (2) has a respective first lateral edge (40) projecting from the flat conveying surface (28) and a respective second lateral edge (39) contacting the push tooth (30), and said conveying pocket (8) comprising a stop element (18) for retaining the first lateral edge (40) of the blank (2); and detaching means (34) for detaching the blank (2) from said flat conveying surface (28) while maintaining the blank (2) secured in a flat configuration between the stop element (18) and the push tooth (30); said detaching means (34) being defined by engaging means (34) for engaging at least one end portion (41) of said blank (2) and detaching the blank (2) from said flat conveying surface (28); said engaging means (34) being located alongside said user path (P1) at said unloading station (S2); wherein the unit comprises guide means (33) located facing said engaging means (34) at said unloading station to guide the second lateral edge (39) of said blank (2) as the blank (2) is inserted inside the respective conveying pocket (8).

8. A unit as claimed in claim 7, wherein said transfer device (9) comprises at least two pickup heads (10) movable cyclically through respective pickup stations and unloading stations (S1, S2); each pickup head (10) inserting the respective blank (2) inside a respective conveying pocket (8) to form a succession (11) of blanks (2) along said user path (P1).

9. A unit as claimed in claim 8, wherein said two pickup heads (10) are synchronized with each other.

10. A unit as claimed in claim 7, wherein said user path (P1) is a straight path; said pickup head (10) being movable along a feed path (P2) tangent to the user path (P1) at said unloading station (S2).

11. A unit as claimed in claim 10 and comprising a hopper (4) containing a stack (5) of blanks (2) and having an open end (6) through which the blanks (2) are withdrawn and which defines said pickup station (S1); said feed path (P2) comprising a portion (T) perpendicular to said open end (6); and the flat conveying surface (28) of said pickup head (10) being positioned coplanar with said open end (6) along said portion (T).

12. A unit as claimed in claim 11, wherein said transfer device (9) comprises an oscillating element (26) for supporting said pickup head (10); the pickup head (10) being fitted in rotary manner to the oscillating element (26).

* * * * *